US008991975B2

(12) United States Patent
Takagi et al.

(10) Patent No.: US 8,991,975 B2
(45) Date of Patent: Mar. 31, 2015

(54) LIQUID EJECTION HEAD HAVING STRUCTURAL MODIFICATIONS TO FILM LAYERS AND METHOD OF MANUFACTURING THE SAME

(71) Applicant: Canon Kabushiki Kaisha, Tokyo (JP)

(72) Inventors: Yosuke Takagi, Yokohama (JP); Yuichiro Akama, Tokyo (JP); Kenji Fujii, Yokohama (JP); Mitsuru Chida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/951,730

(22) Filed: Jul. 26, 2013

(65) Prior Publication Data

US 2014/0035997 A1 Feb. 6, 2014

(30) Foreign Application Priority Data

Jul. 31, 2012 (JP) ..... 2012-169851

(51) Int. Cl.
*B41J 2/135* (2006.01)
*B41J 2/14* (2006.01)
*B41J 2/16* (2006.01)

(52) U.S. Cl.
CPC *B41J 2/14* (2013.01); *B41J 2/1637* (2013.01); *B41J 2/1404* (2013.01); *B41J 2002/14403* (2013.01)
USPC ..... 347/44; 347/65; 347/63

(58) Field of Classification Search
CPC ..... B41J 2/14042; B41J 2/14145; B41J 2/14403; B41J 2/1637
USPC ..... 347/20, 44, 47, 54, 56, 61–65
See application file for complete search history.

(56) References Cited

U.S. PATENT DOCUMENTS

| | | | | |
|---|---|---|---|---|
| 6,186,616 | B1 | 2/2001 | Inoue et al. | |
| 6,390,606 | B1 * | 5/2002 | Terui et al. | 347/63 |
| 6,561,632 | B2 * | 5/2003 | Feinn et al. | 347/65 |
| 7,287,847 | B2 | 10/2007 | Fujii et al. | |
| 7,300,596 | B2 | 11/2007 | Murayama et al. | |
| 7,523,553 | B2 | 4/2009 | Ohsumi et al. | |
| 7,753,502 | B2 | 7/2010 | Fujii et al. | |
| 8,037,603 | B2 | 10/2011 | Fujii et al. | |
| 8,047,632 | B2 | 11/2011 | Fujii et al. | |
| 8,100,505 | B2 | 1/2012 | Kuroda et al. | |
| 2012/0013682 | A1 | 1/2012 | Chida et al. | |

FOREIGN PATENT DOCUMENTS

JP 2005-161763 A 6/2005

* cited by examiner

*Primary Examiner* — Juanita D Jackson
(74) *Attorney, Agent, or Firm* — Fitzpatrick, Cella, Harper & Scinto

(57) ABSTRACT

A liquid ejection head includes a substrate having a supply port that is a through-hole for supplying liquid; an energy generating element for generating energy to be used for ejecting the liquid; a first film that covers the energy generating element; a second film formed on the first film; and a flow path forming member bonded to the substrate, for forming a flow path for supplying the liquid supplied from the supply port to an ejection orifice. When viewed from a direction perpendicular to the substrate, an end portion of the first film extends inwardly from an opening edge of the supply port, and an end portion of the second film is located between the opening edge of the supply port and the end portion of the first film.

15 Claims, 5 Drawing Sheets

LIQUID EJECTION HEAD HAVING STRUCTURAL MODIFICATIONS TO FILM LAYERS AND METHOD OF MANUFACTURING THE SAME

BACKGROUND OF THE INVENTION

1. Field of the Invention

The present invention relates to a liquid ejection head that ejects liquid such as ink on a recording material to perform recording, and a method of manufacturing the liquid ejection head.

2. Description of the Related Art

In an ink jet printer that ejects liquid such as ink, ink is supplied from an ink tank to a liquid ejection head including a silicon substrate having energy generating elements provided on a surface thereof, and ink ejection operation is performed to record an image.

An ink ejection structural portion of the liquid ejection head is formed with use of a semiconductor manufacturing technology in order to reduce the size and increase the density.

In the following, with reference to the drawings, the structure of a conventional liquid ejection head is described.

FIG. 4A is a plan view of an ejection orifice forming surface of the conventional liquid ejection head.

FIGS. 4B to 4D are sectional views taken along the line C-C of FIG. 4A in the conventional liquid ejection head. FIGS. 4B to 4D illustrate the internal structure.

On a silicon substrate 104, multiple energy generating elements 711 for generating energy to eject ink are provided. The energy generating elements 711 are arranged at positions corresponding to ejection orifices, respectively.

When viewed from a bubble generating chamber side, on an ink supply path side, round-shaped nozzle filters 101 for capturing foreign matters such as dust mixed inside the ink are provided. The round-shaped nozzle filters 101 are each formed of a photosensitive resin film 102. The round-shaped nozzle filter 101 prevents occurrence of non-ejection of ink caused by clogging of dust inside the nozzle.

The liquid ejection head having such a configuration is disclosed in, for example, Japanese Patent Application Laid-Open No. 2005-161763. The above-mentioned configuration of the liquid ejection head has generally been put into practical use.

As illustrated in FIGS. 4B to 4D, hitherto, there has been adopted a configuration in which a resin film 105 is formed so as to be prevented from protruding from an upper opening edge of a supply port 106 in the silicon substrate 104 to the inner side of the supply port 106. The reason is as follows. In the region in which the resin film 105 is formed, the thickness of the photosensitive resin film 102 is reduced by the thickness of the resin film 105 (about 2 μm). In order to avoid reduction in degree of freedom of nozzle formation, a region that has no need to form the resin film 105 is reduced as much as possible.

However, in the above-mentioned configuration, in the vicinity of the nozzle filter 101, the photosensitive resin film 102 and a silicon nitride film 103 are directly bonded to each other. Therefore, vibrations to be applied during the manufacturing steps (for example, ultrasonic vibrations used when a flow path pattern member (mold) for forming a bubble generating chamber and a flow path pattern forming a flow path is removed) are directly transmitted to the silicon nitride film 103. Therefore, when the supply port 106 is formed by etching, there is a fear that an end portion (remainder portion) 107 of the silicon nitride film 103, which is generated in an exposed manner at the upper opening edge, is damaged to be chipped. The remainder portion 107 damaged as described above may remain inside the ink flow path, and hence there is a fear that nozzle clogging occurs in the ejection orifice.

When the nozzle is clogged, ejection failure and non-ejection may occur, resulting in a risk of deterioration in recording image quality.

SUMMARY OF THE INVENTION

According to one embodiment of the present invention, there is provided a liquid ejection head, including: a substrate including: a supply port that is a through hole for supplying liquid; an energy generating element for generating energy to be used for ejecting the liquid; a first film that covers the energy generating element; and a second film formed on the first film; and a flow path forming member bonded to the substrate, for forming a flow path for supplying the liquid supplied from the supply port to an ejection orifice, in which, when viewed from a direction perpendicular to the substrate, an end portion of the first film extends inwardly from an opening edge of the supply port, and an end portion of the second film is located between the opening edge of the supply port and the end portion of the first film.

Further, according to one embodiment of the present invention, there is provided a method of manufacturing a liquid ejection head, the method including: preparing a substrate including a supply port that is a through hole for supplying liquid, an energy generating element for generating energy to be used for ejecting the liquid, a first film that covers the energy generating element, and a second film formed on the first film; providing, on the substrate, a mold for forming a flow path; and removing the mold, in which the removing of the mold includes, when viewed from a direction perpendicular to the substrate, extending an end portion of the first film inwardly from an opening edge of the supply port, and locating an end portion of the second film between the opening edge of the supply port and the end portion of the first film.

Further features of the present invention will become apparent from the following description of exemplary embodiments with reference to the attached drawings.

DESCRIPTION OF THE EMBODIMENTS

In the following, specific embodiments of the present invention are described with reference to the drawings.

(First Embodiment)

Figure 3:
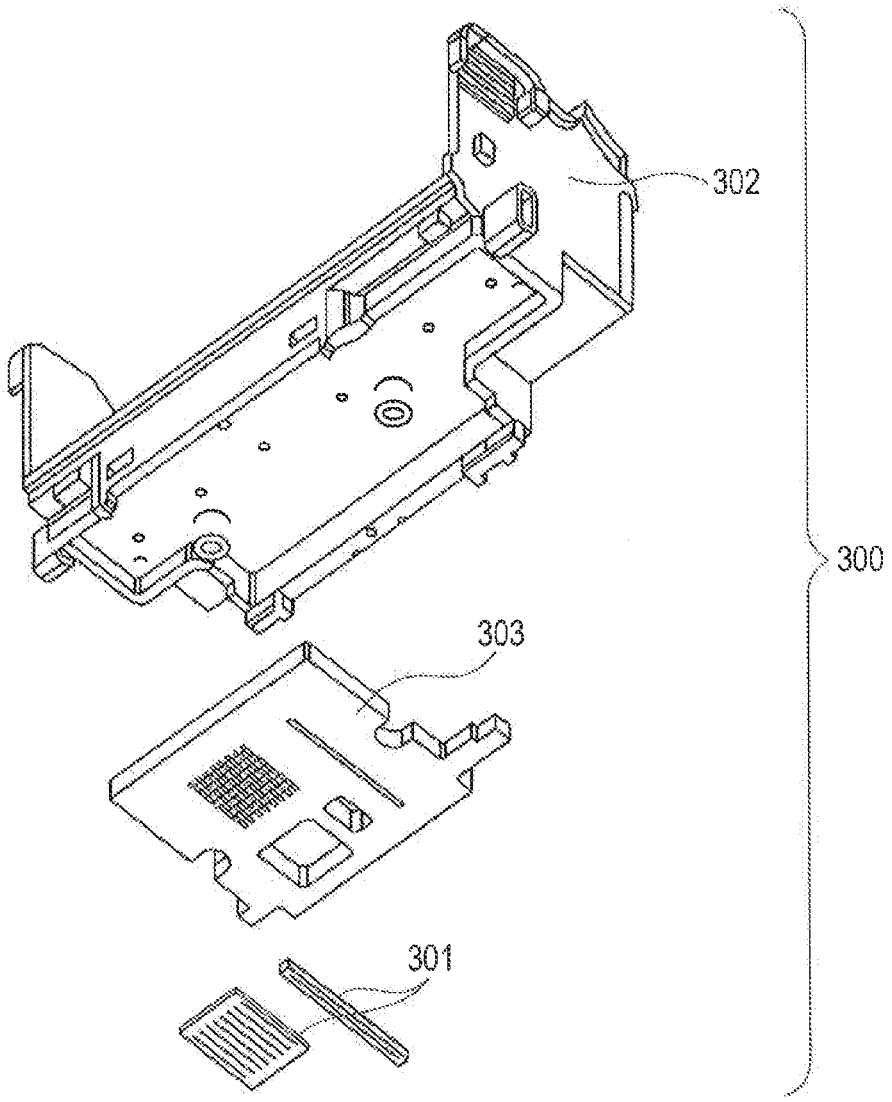
FIG. 3 is an exploded perspective view illustrating a liquid ejection head cartridge of the first embodiment of the present invention.
Figure 4A:
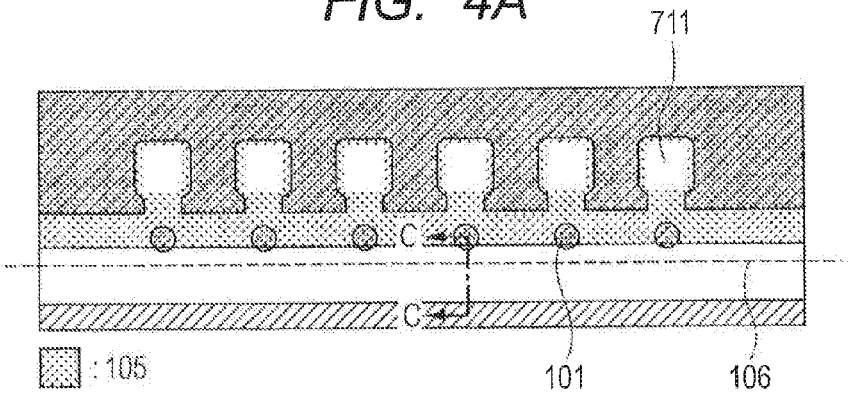
Prior Art FIG. 4A
FIG. 4A is a plan view illustrating an ejection orifice forming surface of a conventional liquid ejection head.
Figure 4B:
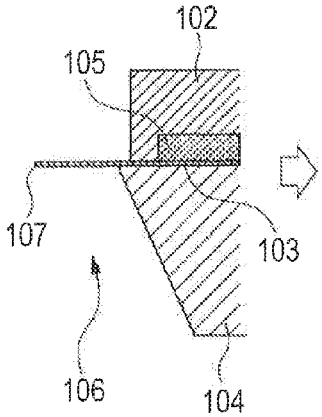
Prior Art FIG. 4B
FIGS. 4B, 4C, and 4D are sectional views taken along the line C-C of FIG. 4A.
Figure 4C:
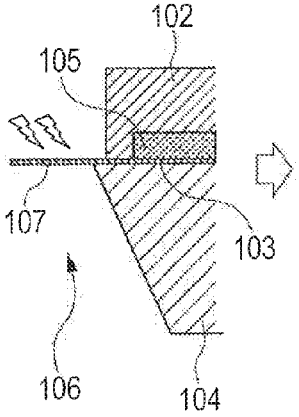
Prior Art FIG. 4C
Figure 4D:
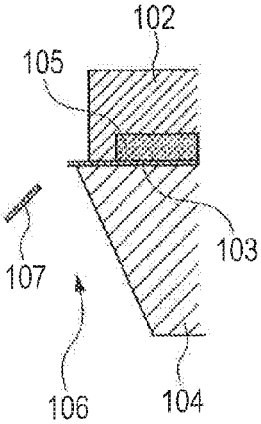
Prior Art FIG. 4D

FIG. 3 is an exploded perspective view of an example of a liquid ejection head cartridge of a first embodiment of the present invention. As illustrated in FIG. 3, a liquid ejection head cartridge 300 includes an ink tank holding unit 302, an ink supply unit 303, and a liquid ejection head 301.

Ink supplied from an ink tank (not shown) is supplied via the ink tank holding unit 302 to the ink supply unit 303, and is ejected from the liquid ejection head 301 bonded to the ink supply unit 303, to thereby perform recording operation.

The liquid ejection head 301 includes a silicon substrate 104, and a photosensitive resin film 102 that is arranged on the silicon substrate 104 and has multiple ejection orifices formed therein.

Between the silicon substrate 104 and the photosensitive resin film 102, a silicon oxide film, a silicon nitride film 103, and a resin film 105 are formed so as to be laminated in the stated order. The silicon oxide film is formed for the purpose of insulating the surface of the silicon substrate 104. The silicon nitride film 103 is formed as an upper layer of the silicon oxide film, and functions as a protective film for an energy generating element 711. The resin film 105 is provided between the photosensitive resin film 102 and the silicon nitride film 103. The resin film 105 has a function as a bonding film for bonding together the silicon substrate 104 and the photosensitive resin film 102, to thereby improve the adhesion.

Further, the ink supplied from the ink cartridge is supplied from a supply port 106 via an ink flow path to the ejection orifice. The ink supplied in the vicinity of the ejection orifice is ejected from the ejection orifice by driving the energy generating element 711 in accordance with an electrical signal to perform ink ejection operation.

Next, the steps of manufacturing the liquid ejection head are described. First, the silicon nitride film 103 which is to be a protective film of the energy generating element is applied on the silicon substrate 104 and is patterned into a predetermined shape. Thereafter, the resin film 102 is applied on the silicon nitride film 103 and is patterned into a predetermined shape. At that time, the patterning is conducted such that an end portion of the silicon nitride film 103 and an end portion of the resin film 105 are positioned as shown in FIG. 2B. Then the photosensitive resin film 102 is applied by well-known method to form the flow path and the like. Subsequently, the silicon substrate 104 is etched, whereby the supply port 106 is formed.

Figure 1A:
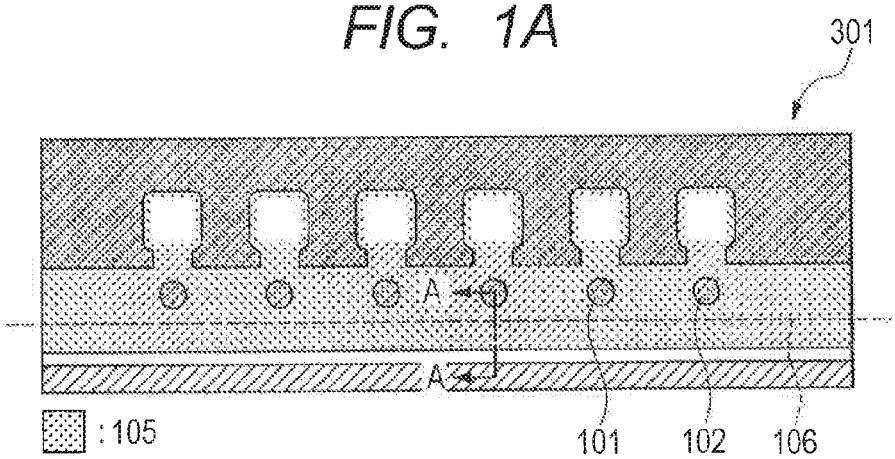
FIG. 1A is a plan view illustrating an ejection orifice forming surface of a liquid ejection head according to a first embodiment of the present invention.
Figure 1B:
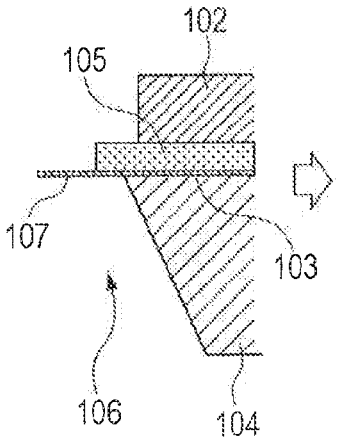
FIGS. 1B, 1C, and 1D are sectional views taken along the line A-A of FIG. 1A.
Figure 1C:
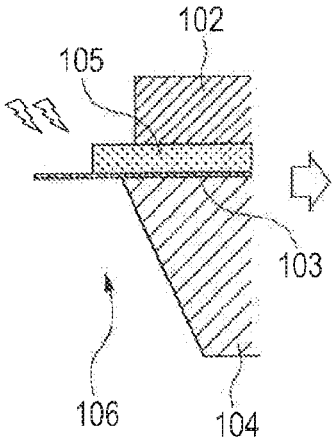
Figure 1D:
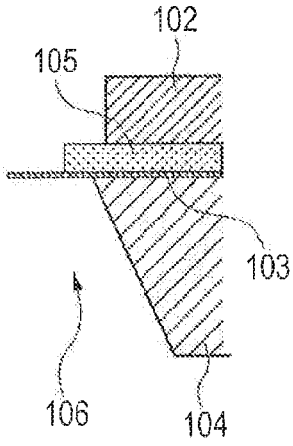

FIG. 1A is a plan view of an ejection orifice forming surface of the liquid ejection head of the first embodiment of the present invention, and FIGS. 1B to 1D are sectional views taken along the line A-A of FIG. 1A.

The liquid ejection head 301 of the first embodiment includes the silicon substrate 104. The silicon substrate 104 has the supply port 106 (liquid supply port) for supplying ink as the liquid, and the energy generating element for applying energy to ink supplied from the supply port 106. Further, the liquid ejection head 301 includes the photosensitive resin film 102 that is bonded to the silicon substrate 104 and has the multiple ejection orifices for ejecting ink, and the silicon nitride film (first film) 103 formed on the silicon substrate 104 so as to cover the energy generating element. Further, the liquid ejection head 301 includes the resin film (second film) 105 that is provided between the silicon nitride film 103 and the photosensitive resin film (flow path forming member) 102 and bonds together the silicon nitride film 103 and the photosensitive resin film 102. In this embodiment, the resin film 105 is a film containing poly(etheramide).

As illustrated in FIG. 1A, the liquid ejection head 301 includes round-shaped nozzle filters 101 each formed of the photosensitive resin film 102.

As illustrated in FIGS. 1A to 1D, the liquid ejection head 301 of this embodiment differs from the conventional configuration illustrated in FIGS. 4A to 4D in a region in which the resin film 105 is formed. Other configurations of this embodiment are similar to those of the conventional liquid ejection head illustrated in FIGS. 4A to 4D, and hence detailed description of the components having the same function as those in the conventional case is omitted.

In the following, the action of preventing damage on a remainder portion (end portion) of the silicon nitride film 103 in this embodiment is described.

In the configuration of the conventional liquid ejection head illustrated in FIGS. 4A to 4D, the resin film 105 is not protruded on the inner side of the supply port 106 from the upper opening edge of the supply port 106 in the silicon substrate 104, the upper opening edge being provided in parallel to the arranging direction of the multiple ejection orifices. Therefore, in the vicinity of the nozzle filter 101, there is a region in which the photosensitive resin film 102 and the silicon nitride film 103 are brought into direct contact with each other.

In the case of this configuration, vibrations to be applied during the manufacturing steps (for example, ultrasonic vibrations used when the mold for forming the bubble generating chamber and the flow path pattern forming the flow path is removed) are directly transmitted to the silicon nitride film 103. Therefore, when the supply port 106 is formed by etching, there is a fear that the remainder portion 107 of the silicon nitride film 103, which is generated in an exposed manner at the upper opening edge portion, is damaged to be chipped. As a result, the piece of the damaged remainder portion 107 may induce damage on the photosensitive resin film 102.

As a countermeasure, in this embodiment, as illustrated in FIGS. 1A to 1D, the resin film 105 is formed so as to extend along the photosensitive resin film 102 in the opening plane of the supply port 106 from the opening edge of the supply port 106 toward the inner side of the supply port 106.

Further, the resin film 105 is preferred to be made of a material that has hardness lower than those of the photosensitive resin film 102 and the silicon substrate 104. In this manner, the effect of preventing damage on the remainder portion 107 can be further improved.

In addition, in this embodiment, the end portion of the resin film 105 extending from the opening edge of the supply port 106 toward the inner side of the supply port 106 is located on the opening edge side of the supply port 106 with respect to the remainder portion 107 of the silicon nitride film 103. With this, the resin film 105 can prevent the remainder portion 107 of the silicon nitride film 103 from being damaged, and the resin film 105 is prevented from being damaged as well.

According to the configuration of this embodiment, the liquid ejection head 301 is formed so that, above the inner side of the supply port 106, the upper surface side of the remainder portion 107 of the silicon nitride film 103 is covered with the resin film 105. With this, the vibrations applied to the photosensitive resin film 102 when the mold is removed are not directly transmitted to the silicon nitride film 103, and the resin film 105 exerts the effect of relaxing the stress. Therefore, it is possible to prevent the damage on the remainder portion 107 and prevent the nozzle from clogging.

(Second Embodiment)

Figure 2A:
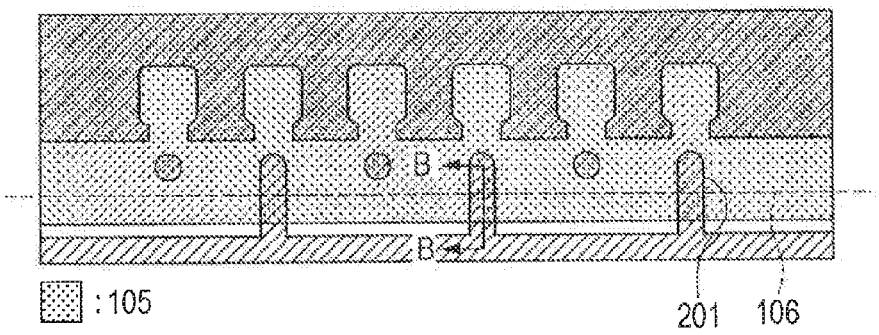
FIG. 2A is a plan view of an ejection orifice forming surface of a liquid ejection head according to a second embodiment of the present invention.
Figure 2B:
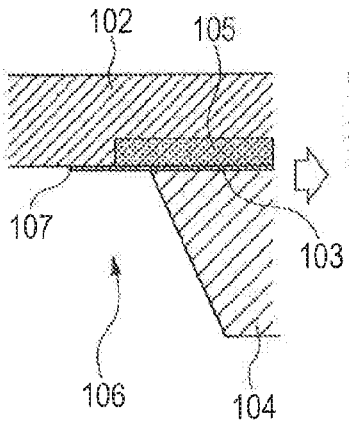
FIGS. 2B, 2C, and 2D are sectional views taken along the line B-B of FIG. 2A.
Figure 2C:
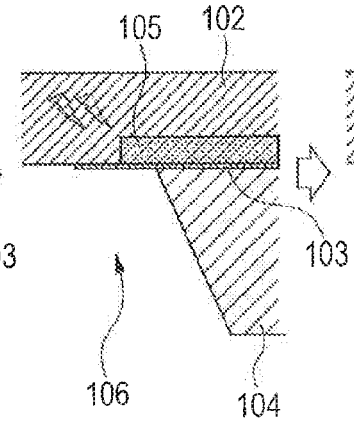
Figure 2D:
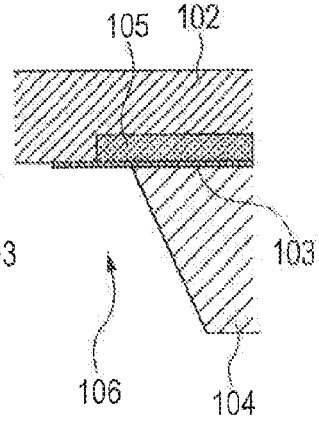

FIG. 2A is a plan view of an ejection orifice forming surface of a liquid ejection head according to a second embodiment of the present invention, and FIGS. 2B to 2D are sectional views taken along the line B-B of FIG. 2A.

Figure 5A:
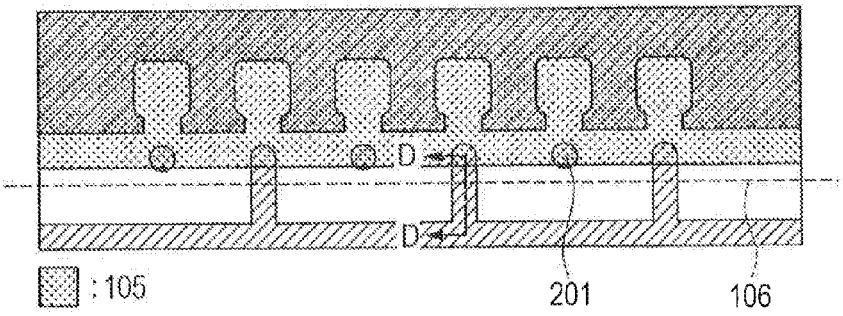
Prior Art FIG. 5A
FIG. 5A is a plan view illustrating an ejection orifice forming surface of another conventional liquid ejection head.
Figure 5B:
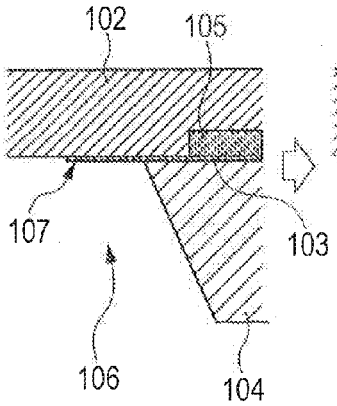
Prior Art FIG. 5B
FIGS. 5B, 5C, and 5D are sectional views taken along the line D-D of FIG. 5A.
Figure 5C:
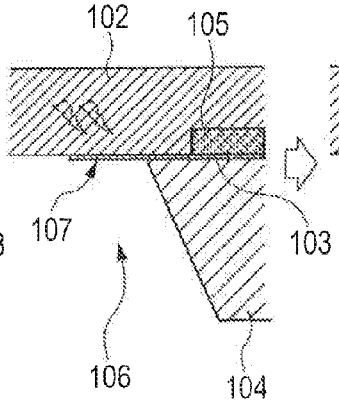
Prior Art FIG. 5C
Figure 5D:
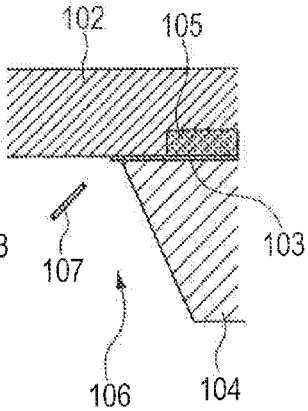
Prior Art FIG. 5D

FIG. 5A is a plan view of an ejection orifice forming surface of another conventional liquid ejection head. FIGS. 5B to 5D are sectional views of the conventional liquid ejection head taken along the line D-D of FIG. 5A. FIGS. 2B to 2D and 5B to 5D illustrate the internal structure.

In the above-mentioned first embodiment of the present invention, the liquid ejection head adopting the round-shaped nozzle filter 101 is applied, but also a liquid ejection head adopting a rib-shaped nozzle filter 201 exerts similar effects.

Depending on the type of the ink, the photosensitive resin film 102 may swell. In this case, there is a fear that the photosensitive resin film 102 may peel off from the silicon substrate 104. As a countermeasure, in some cases, as illustrated in FIG. 5A, the rib-shaped nozzle filter 201 is adopted as the nozzle filter to increase the area in which the photosensitive resin film 102 and the silicon substrate 104 are brought into contact with each other. The rib-shaped nozzle filter 201 is formed of the photosensitive resin film 102 similarly to the round-shaped nozzle filter 101.

By the way, in the case of the configuration in which the rib-shaped nozzle filter 201 is used as described above, as illustrated in FIGS. 5B to 5D, the area in which the photosensitive resin film 102 and the silicon nitride film 103 are brought into direct contact with each other increases. Therefore, due to the vibrations of the photosensitive resin film 102 generated during the manufacturing steps, the rate of occurrence of damage on the remainder portion 107 of the silicon nitride film 103 increases.

As illustrated in FIGS. 2A to 2D, the liquid ejection head 301 of this embodiment differs from the conventional configuration illustrated in FIGS. 5A to 5D in the region in which the resin film 105 is formed. Other configurations are similar to those of the conventional liquid ejection head illustrated in FIGS. 5A to 5D, and hence detailed description of the components having the same function as those in the conventional case is omitted.

Also in the second embodiment of the present invention, as illustrated in FIGS. 2A to 2D, the photosensitive resin film 102 is formed immediately above the upper opening edge of the supply port 106, the upper opening edge being provided in parallel to the arranging direction of the multiple ejection orifices. Also with this configuration, the resin film 105 covers the silicon nitride film 103 to exert the effect of relaxing the stress. Therefore, in the second embodiment of the present invention, similarly to the first embodiment of the present invention, the resin film 105 can prevent the remainder portion 107 of the silicon nitride film 103 from being damaged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169851, filed Jul. 31, 2012, which is hereby incorporated by reference herein in its entirety.

What is claimed is:

1. A liquid ejection head comprising:

a substrate comprising:

a supply port that is a through-hole for supplying liquid;

an energy generating element for generating energy to be used for ejecting the liquid;

a first film that covers the energy generating element; and a second film formed on the first film; and a flow path forming member bonded to the substrate, for forming a flow path for supplying the liquid supplied from the supply port to an ejection orifice, wherein, when viewed from a direction perpendicular to the substrate, an end portion of the first film extends inwardly from an opening edge of the supply port, the end portion of the first film being a single layer, and an end portion of the second film is located between the opening edge of the supply port and the end portion of the first film.

2. The liquid ejection head according to claim 1, wherein the second film is made of a material having a hardness lower than a hardness of the flow path forming member.

3. The liquid ejection head according to claim 1, wherein, when viewed from the direction perpendicular to the substrate, the end portion of the second film extends inwardly from the opening edge of the supply port.

4. The liquid ejection head according to claim 1, wherein the first film comprises a silicon nitride film.

5. The liquid ejection head according to claim 1, wherein the second film comprises a film containing poly(etheramide).

6. A method of manufacturing a liquid ejection head, the method comprising:

preparing a substrate comprising a supply port that is a through-hole for supplying liquid, an energy generating element for generating energy to be used for ejecting the liquid, a first film that covers the energy generating element, and a second film formed on the first film; and forming a flow path on the substrate, wherein forming the substrate comprises, when viewed from a direction perpendicular to the substrate, extending an end portion of the first film inwardly from an opening edge of the supply port, the end portion of the first film being a single layer, and locating an end portion of the second film between the opening edge of the supply port and the end portion of the first film.

7. The method of manufacturing a liquid ejection head according to claim 6, further comprising providing a molded flow path forming member to form the flow path.

8. The method of manufacturing a liquid ejection head according to claim 6, wherein the first film comprises a silicon nitride film.

9. The method of manufacturing a liquid ejection head according to claim 6, wherein the second film comprises a film containing poly(etheramide).

10. The method of manufacturing a liquid ejection head according to claim 6, wherein forming the flow path comprises use of an ultrasonic wave.

11. A liquid ejection head comprising:

a substrate comprising:

a supply port that is a through-hole for supplying liquid;

an energy generating element for generating energy to be used for ejecting the liquid;

a first film that covers the energy generating element; and a second film formed on the first film, the second film having a greater thickness than that of the first film; and a flow path forming member bonded to the substrate, for forming a flow path for supplying the liquid supplied from the supply port to an ejection orifice, wherein, when viewed from a direction perpendicular to the substrate, an end portion of the first film extends inwardly from an opening edge of the supply port, the end portion of the first film being a single layer, and an end portion of the second film is located between the opening edge of the supply port and the end portion of the first film.

12. The liquid ejection head according to claim 11, wherein the second film is made of a material having a hardness lower than a hardness of the flow path forming member.

13. The liquid ejection head according to claim 11, wherein, when viewed from the direction perpendicular to the substrate, the end portion of the second film extends inwardly from the opening edge of the supply port.

14. The liquid ejection head according to claim 11, wherein the first film comprises a silicon nitride film.

15. The liquid ejection head according to claim 11, wherein the second film comprises a film containing poly(etheramide).

* * * * *